United States Patent [19]

Crossley et al.

[11] Patent Number: 4,758,710

[45] Date of Patent: Jul. 19, 1988

[54] HEATING APPARATUS

[75] Inventors: Peter W. Crossley, Havant; Bernard F. Fellerman, Hayling Island; Stephen J. Newton, Midhurst; David Wellcome, Chichester, all of England

[73] Assignee: Thorn EMI Appliances Limited, London, England

[21] Appl. No.: 98,704

[22] Filed: Sep. 18, 19877587100310032193 64

[51] Int. Cl.[4] ..... F24H 3/00; H05B 1/00; H05B 3/02

[52] U.S. Cl. ..... 219/446; 219/364; 219/461; 219/464

[58] Field of Search ..... 219/445–446, 219/448, 461, 464, 364, 354, 358, 501; 322/23 SC; 323/905

[56] References Cited

U.S. PATENT DOCUMENTS

| | | | |
|---|---|---|---|
| 3,369,108 | 2/1968 | Strachan | 219/501 |
| 4,238,665 | 12/1980 | Tremarco | 219/228 |
| 4,551,616 | 11/1985 | Buttery | 219/354 |

FOREIGN PATENT DOCUMENTS

| | | |
|---|---|---|
| 2118407 | 4/1971 | Fed. Rep. of Germany . |
| 2132060 | 6/1984 | United Kingdom . |

*Primary Examiner*—E. A. Goldberg
*Assistant Examiner*—L. Donovan
*Attorney, Agent, or Firm*—Fleit, Jacobson, Cohn & Price

[57] ABSTRACT

A heating unit includes two tubular tungsten-halogen lamps, each having a tungsten filament. The lamps are supported within a ring of ceramic fibre material and the unit is preferably mounted beneath an infra-red-transmissive cooktop to define a hotplate area of a cooking hob. A control circuit provides a range of discrete power outputs of the lamps, each power output corresponding to a power control setting set by a user of the cooking hob. The circuit includes a phase control circuit for switching power to the lamps at a predetermined phase angle to achieve one or more of the lower power outputs.

4 Claims, 3 Drawing Sheets

| SETTING No. | SWITCHES CLOSED | POWER (W) | LAMP CONFIGURATION |
|---|---|---|---|
| 6 | 12,14,15 | 1200 | L — 3 / 4 — N |
| 5 | 11,13,15 | 690 | L — 17 18 3 4 — N |
| 4 | 12,16 | 410 | L — 3 4 — N |
| 3 | 11,16 | 220 | L — 17 3 4 — N |
| 2 | 9,10,16 | ≈150 | L — PHASE CONTROL CIRCUIT 19 3 4 — N |
| 1 | 10,16 | ≈110 | L — PHASE CONTROL CIRCUIT 19 3 4 — N |
| OFF | — | — | |

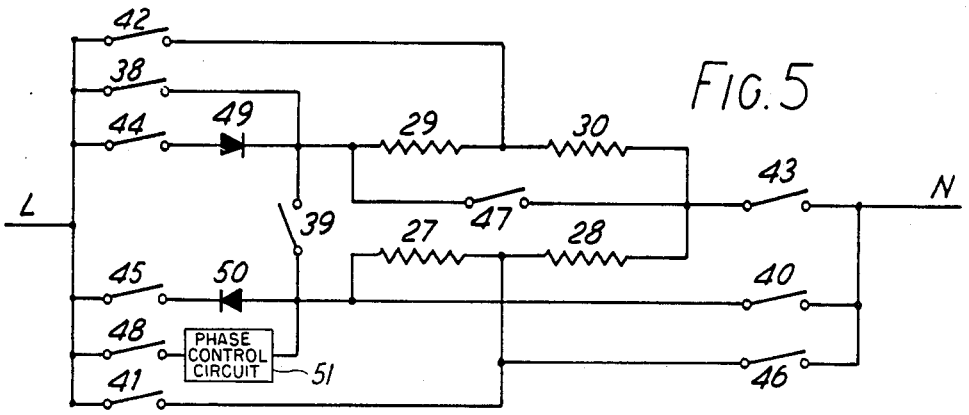
FIG. 5
FIG. 6
| SETTING No. | SWITCHES CLOSED | POWER (W) | LAMP CONFIGURATION |
|---|---|---|---|
| 5I | 40,41,43 | 1000 | 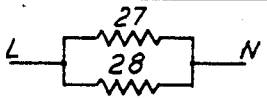 |
| 4I | 44,45,46,47 | 575 | 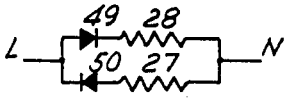 |
| 3I | 38,40,47 | 340 | 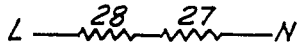 |
| 2I | 43,45 | 187 | 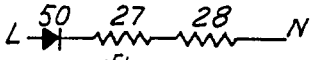 |
| 1I | 43,48 | 116 | 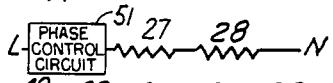 |
| 1D | 40,44 | 130 | 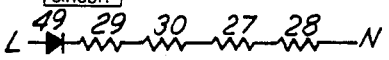 |
| 2D | 38,40 | 240 | 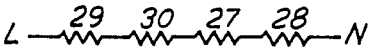 |
| 3D | 43,44,45 | 440 | 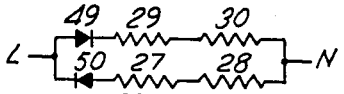 |
| 4D | 38,39,43 | 730 | 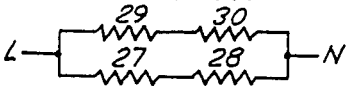 |
| 5D | 38,40,41,43 | 1400 | 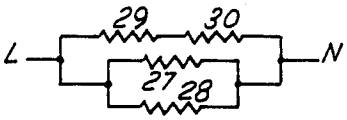 |
| 6D | 47,40,41,42,43 | 2200 | 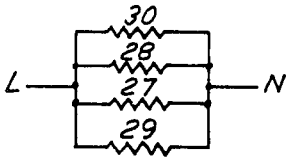 |
| OFF | — | — | — |

HEATING APPARATUS

This application is a continuation of application Ser. No. 769,731, filed Aug. 27, 1985, now abandoned.

This invention relates to heating apparatus and in particular, though not exclusively, to such apparatus incorporating one or more sources of infra-red radiation, as disclosed in our copending U.K. Patent Application No. 8320717 (Publication No. 2132060A).

The heating apparatus disclosed in 8320717 includes, in one embodiment, four infra-red-emitting, tungsten-halogen lamps arranged in a heating unit, which is disposed beneath an infra-red-transmissive, glass ceramic layer to form a hotplate area of cooking hob. The tungsten filaments of the lamps are switched in various series and/or parallel configurations to achieve a range of discrete power outputs providing a suitable temperature control of the hotplate. A diode is also arranged to be connected into one or more of the lamp configurations to achieve the lower power outputs.

However, a smaller hotplate, using less than four lamps in one heating unit, may be desirable, in which case fewer lamp configurations, and thus power outputs, would be possible to achieve. In particular, relatively low power outputs, which are generally required for simmering purposes would not be available using known switching techniques.

It is therefore an object of the present invention to provide heating apparatus of the above-mentioned type, which is capable of achieving a wider range of discrete power outputs than hitherto.

According to the present invention there is provided heating apparatus including a plurality of sources of infra-red radiation and a control circuit for providing a plurality of discrete power outputs of said sources, said control circuit including means for switching power to said sources at a predetermined phase angle to achieve at least one of said power outputs.

Preferably the sources of infra-red radiation each comprises a tungsten filament supported in a quartz envelope, and the control circuit is arranged to switch the filaments into series and/or parallel configurations to achieve each of the discrete power outputs.

The means for switching power to said sources at a predetermined phase angle may be connected into one or more of the filament configurations to increase the range of available power outputs, and in particular to achieve relatively low power outputs.

The present invention may be used to provide a dual control arrangement of a heating unit comprising, for example, four infra-red lamps, wherein a wide range of power outputs may be achieved from two inner-positioned lamps, which are energisable independently of the two outer-positioned lamps.

The invention will now be further described by way of example only with reference to the accompanying drawings, wherein:

FIG. 5 shows a control circuit for the second embodiment, and FIG. 6 shows a table of the range of power outputs provided by the circuit in FIG. 5.

Figure 1:
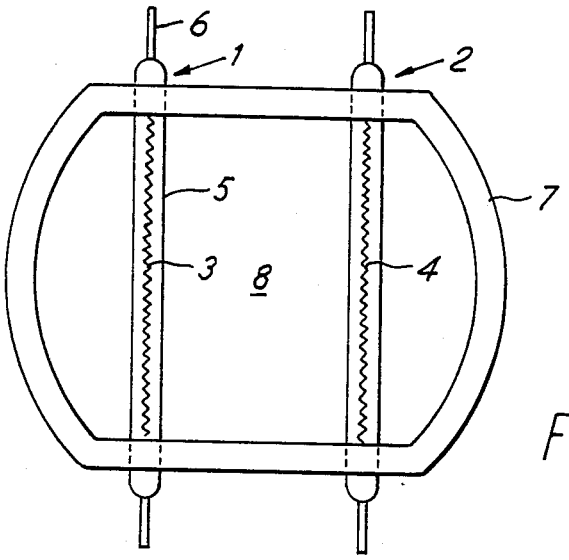
FIG. 1 shows one embodiment of the present invention.

FIG. 1 shows a heating unit including two tubular infra-red-emitting, tungsten-halogen lamps 1 and 2, each having a tungsten filament, 3 and 4, respectively supported within a quartz envelope, such as 5. Each end of each lamp 1, 2 is provided with a pinch seal, such as 6, having an electrical connection to the filament sealed therein. The lamps 1, 2 are supported within a ring of ceramic fibre material 7, and the unit is preferably mounted beneath a layer of infra-red-transmissive material, such as glass ceramic (not shown), so as to define a hotplate area 8 of a cooking hob.

The lamps 1, 2 and the ceramic fibre material 7 are preferably mounted above a supportive, shallow, metallic tray (not shown), containing a layer of thermally-insulative and reflective material (also not shown) as disclosed in our copending U.K. Patent Application No.8320717 (Publication No.2132060A).

Figures 2, 3:
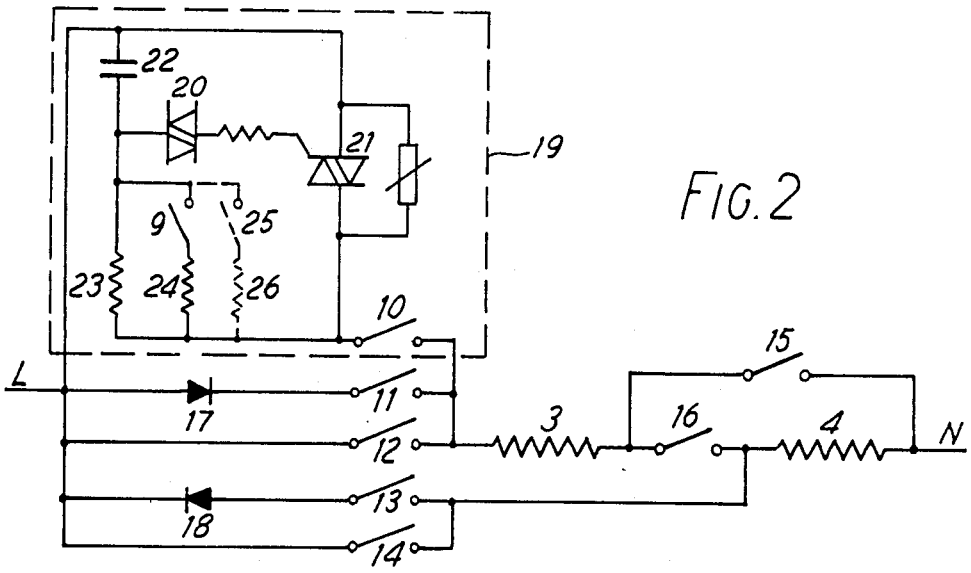
FIG. 2 shows a control circuit for the embodiment in FIG. 1.
FIG. 3 shows a table of the range of power outputs provided by the circuit in FIG. 2.

FIG. 2 shows a control circuit for providing a range of discrete power outputs of the lamps 1, 2 each power output corresponding to a power control setting number, as shown in FIG. 3, set by a user of the cooking hob. The control circuit includes eight switches 9 to 16, inclusive, which provide six discrete power outputs of the lamps 1, 2 by selectively closing a number of the switches. Series and/or parallel lamp configurations, each producing a particular power output, are also shown in FIG. 3, and it can be seen that, in two of the configurations, one or more diodes are also required to achieve the desired power output. The diodes are shown at 17 and 18 in the circuit in FIG. 2 and can be switched into the lamp configurations when required.

However, use of series and/or parallel lamp configurations and diodes are not sufficient to achieve the two lowest power outputs of approximately 150 W and 110 W, respectively, which are generally required for simmering purposes, and to this end, the present invention provides a phase control circuit 19, which may also be switched into one or more of the lamp configurations by closure of the swtich 10. The circuit 19 includes a diac 20 and a triac 21, the conducting time of which is determined by a capacitor 22 and resistors 23, 24. By selecting either resistor 23 or resistors 23 and 24, via switch 9, a predetermined phase angle is generated by the phase control circuit 19, which thus changes the power output. So that, for setting No.2, switches 9 and 10 are closed to produce a first predetermined phase angle, which achieves a power output of approximately 150 W, and for setting No.1, switch 9 is open and switch 10 is closed to produce a second predetermined phase angle, which achieves a power output of approximately 110 W. Switch 25 and resistor 26, shown in dotted lines, may be used to provide a third predetermined phase angle, which achieves a power output of approximately 200 W, and may thus be employed as an alternative to setting No.3 as shown in FIG. 3.

The heating unit shown in FIG. 1 preferably has a diameter of approximately 155 mm and each of the lamps 1, 2 preferably has a filament length of 128 mm with a power output of 600 W.

However, any alternative power outputs of the lamps may of course be utilised, such as 900 W, for example, in which case the maximum combined output would be 1800 W and the lower outputs would be proportionally higher than those shown in FIG. 3.

Figure 4:
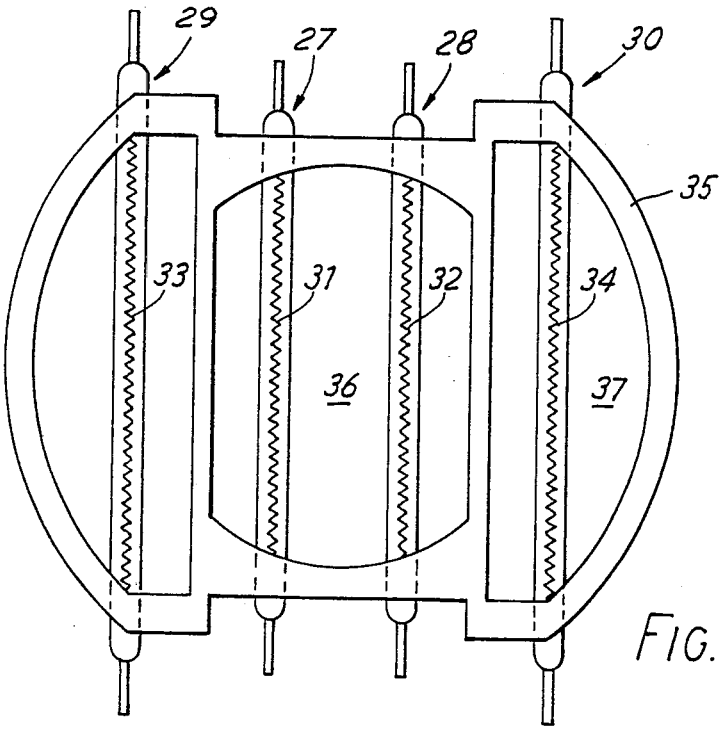
FIG. 4 shows a second embodiment of the invention.

FIG. 4 shows an alternative embodiment of the invention, wherein two inner lamps 27, 28 and two outer lamps 29, 30 are provided, each of the lamps 27 to 30, having a tungsten filament 31 to 34, respectively, are supported in ceramic fibre material 35.

By employing a phase control circuit, as shown at 19 in FIG. 2, the two inner lamps 27, 28 may be energised independently of the two outer lamps 29, 30, thereby providing a dual-ring hotplate, wherein either only central region 36 or whole hotplate area 37 may be heated by the lamps.

FIG. 5 shows a control circuit including eleven switches 38 to 48, inclusive, two diodes 49, 50 and a phase control circuit denoted schematically at 51. By selectively closing the switches 38 to 48, five settings 1I to 5I can be achieved for the central region 36 with only inner lamps 31, 32 energised, and six settings 1D to 6D can be achieved for the whole hotplate area 37 with all four lamps 31 to 34 energised. It can be seen that the phase control circuit 51 is required to achieve the lowest setting 1I to produce a power output of approximately 116 W, which is suitable for simmering purposes.

The phase control circuit 51 may, in fact, be employed in any lamp configuration, shown in FIG. 6, which produces a power output of up to 340 W.

For the embodiment shown in FIG. 4, the diameter of the central region 36 is preferably approximately 125 mm and the whole hotplate area 37 is preferably approximately 200 mm. The inner lamps 27, 28 preferably each have a power output of 500 W with a filament length of 117 mm and the two outer lamps 29, 30 preferably each have a power output of 600 W with a filament length of 145 mm.

It can thus be seen that by use of the phase control circuit in one or more of the lamp configurations, relatively low power outputs can be achieved with a minimum number of two infra-red lamps, thereby enabling smaller hotplate areas, as well as dual-ring hotplates, to be provided in a cooking hob incorporating such lamps.

When only two lamps are utilised, as shown in FIG. 1, the lamps may be configured into a curved shape to provide efficient illumination of the whole hotplate area. To inhibit the formation of hotspots on the cooking hob cooktop, the two lamps may be inclined towards one another, at their closest approach, so that they are at their greatest distance from the cooktop at this point. Alternatively or additionally, a partially infra-red-reflective coating can be applied on the upper part of the outer envelope of each lamp to inhibit direct upward transmission in infra-red radiation from the lamps to the underside of the cooktop, as well as the usual infra-red-reflective coating on the lower part of each lamp envelope to reflect infra-red radiation generated by the lamp filament generally in a direction towards the underside of the cooktop.

What is claimed is:

1. A heating apparatus comprises a plurality of lamps emissive of infra-red radiation and connectable to a power supply, and a user-operable control circuit for selecting any one of a number of different power settings, wherein said user-operable control circuit includes, a phase control circuit comprising a diac and a triac arrangement having a pre-determined conducting time to provide phase control of power supplied to the lamps and a resistor-capacitor network for determining said conducting time;

at least one diode, a first switching means for selectively switching the lamps into a number of different interconnections, and second and third switching means for selectively switching the phase control circuit and said at least one diode respectively into at least one said interconnection thereby to attain a selected power setting.

2. Heating apparatus as claimed in claim 1 wherein said first switching means is adapted to interconnect said lamps into at least one of a series and parallel arrangement.

3. Heating apparatus as claimed in claim 1 wherein each of said lamps comprises a quartz envelope and a tungsten filament supported in said envelope.

4. Heating apparatus as claimed in claim 1 and further comprising an inner region accomodating said plurality of lamps, an outer region accomodating at least one further lamp, and further switching means to enable energisation of said plurality of lamps independently of said at least one further lamp.

* * * * *